US007191751B2

(12) United States Patent
Vick et al.

(10) Patent No.: US 7,191,751 B2
(45) Date of Patent: Mar. 20, 2007

(54) HANDLE FOR A PULL-ROPE STARTER OF A MOTOR-DRIVEN CHAIN SAW

(75) Inventors: Christian Vick, Winsen (DE); Roland Ladwig, Mechtersen (DE)

(73) Assignee: Dolmar GmbH, Hamburg (DE)

( * ) Notice: Subject to any disclaimer, the term of this patent is extended or adjusted under 35 U.S.C. 154(b) by 90 days.

(21) Appl. No.: 10/947,884

(22) Filed: Sep. 22, 2004

(65) Prior Publication Data

US 2005/0066928 A1 Mar. 31, 2005

(30) Foreign Application Priority Data

Sep. 26, 2003 (DE) ..... 203 14 982 U

(51) Int. Cl.
*F02N 3/02* (2006.01)

(52) U.S. Cl. ..... 123/185.2; 16/442

(58) Field of Classification Search ..... 123/185.2, 123/185.3, 185.4; 16/442
See application file for complete search history.

(56) References Cited

U.S. PATENT DOCUMENTS

| | | | | |
|---|---|---|---|---|
| 2,722,209 | A | 11/1955 | Pillow | 123/185 |
| 3,092,156 | A | 6/1963 | Hayden | |
| 3,656,468 | A | 4/1972 | Weldon | 125/13 |
| 4,204,714 | A | 5/1980 | Jacobson et al. | 299/1 |
| 4,370,954 | A * | 2/1983 | Asao et al. | 123/185.3 |
| 5,153,967 | A | 10/1992 | Zimmermann et al. | 16/122 |
| 6,595,840 | B1 | 7/2003 | Jaensch et al. | 451/358 |
| 6,742,265 | B2 | 6/2004 | Radel et al. | 30/382 |
| 6,814,192 | B2 | 11/2004 | Ziegs et al. | |
| 2004/0172834 | A1 | 9/2004 | Ziegs et al. | 30/381 |
| 2004/0183274 | A1 | 9/2004 | Schipper | |
| 2005/0055832 | A1 | 3/2005 | Jaensch | |

FOREIGN PATENT DOCUMENTS

| | | |
|---|---|---|
| DE | 30 21 268 A1 | 3/1981 |
| DE | 40 25 667 C2 | 2/1992 |
| DE | 198 39 341 A1 | 2/2000 |
| DE | 203 04 278 U1 | 3/2003 |
| EP | 1 203 883 A2 | 5/2002 |

* cited by examiner

*Primary Examiner*—Andrew M. Dolinar
(74) *Attorney, Agent, or Firm*—Nash and Titus, LLC

(57) ABSTRACT

The invention entails a handle for a pull-rope starter of a drive motor, especially of a chain saw. The invention includes at least one handle section, at least one fastening section for a starter rope, and a damping for smoothing out force peaks produced in the handle during the starting of the drive motor. The damping is arranged in the handle section.

6 Claims, 3 Drawing Sheets

HANDLE FOR A PULL-ROPE STARTER OF A MOTOR-DRIVEN CHAIN SAW

BACKGROUND OF THE INVENTION

Internal combustion engines of manually guided work tools such as motor-driven chain saws, abrasive cutting-off machines, etc. are provided with a starting device that can be actuated manually. A starter rope rolled up on a reel or winch is rapidly pulled on a handle, which causes it to be rolled off. The reel, put in rotation by the pulling, drives the motor crankshaft of the internal combustion engine in order to start it. Periodic forces and in particular force peaks occur in the hand of the user during the pulling of the starter rope. The force peaks make the starting of the internal combustion engine particularly unpleasant for the user. Handles with dampings are provided in the state of the art in order to smooth out the force peaks.

DE 30 21 268 A1 discloses a handle with a damping element separate from it, which damping element is part of the pull-rope fastening on the handle. The force peaks are smoothed out by an elastic deformation of the damping element. The damping element is compressed or clinched in the handle.

In contrast thereto, DE 40 25 667 C2 describes a handle with an extension element. In the handle described in this publication an end of a starter rope is fastened to an extension element and the extension element is clamped in a recess of the handle. The expansion element is expanded in the handle when the starter rope is pulled and as a result smoothes out force peaks.

Both of the handles described above are designed as substantially T-shaped, one-piece rubber molded parts. The damping element is designed as a separate component and inserted into the handle. The manufacture of multipartite damped handles is cost-intensive. In addition, the handle and the end of the starter rope of the cited pull-rope starters execute a relative motion relative to one another, during which friction causes additional material wear.

In another previously known variant of damped handles described in EP 1 203 883 A2 the reel is elastically connected to the starter housing by a spiral spring. A multipartite, relatively expensive construction is required here, as in the case of the two first-cited handle dampings.

The above-described handles of starting devices for internal combustion engines are material-intensive. In addition, the contact surfaces between the hand and/or the fingers in the handle are stiff, which can result in cramping in the hand if the starter rope is pulled several times.

SUMMARY OF THE INVENTION

The invention therefore addresses the problem of making available an improved handle for a pull-rope starter of a drive motor.

This problem is solved by a handle of the initially cited type whose damping is arranged in the handle section.

In particular, the invention entails a handle for a pull-rope (or pull-cable) starter of a drive motor, especially of a motor-driven chain saw, with at least one handle section and at least one fastening section for a starter rope and a damping for smoothing out stabilizing, equalizing force or power peaks produced in the handle during the starting of the drive motor.

DESCRIPTION OF THE PREFERRED EMBODIMENTS

Figure 1:
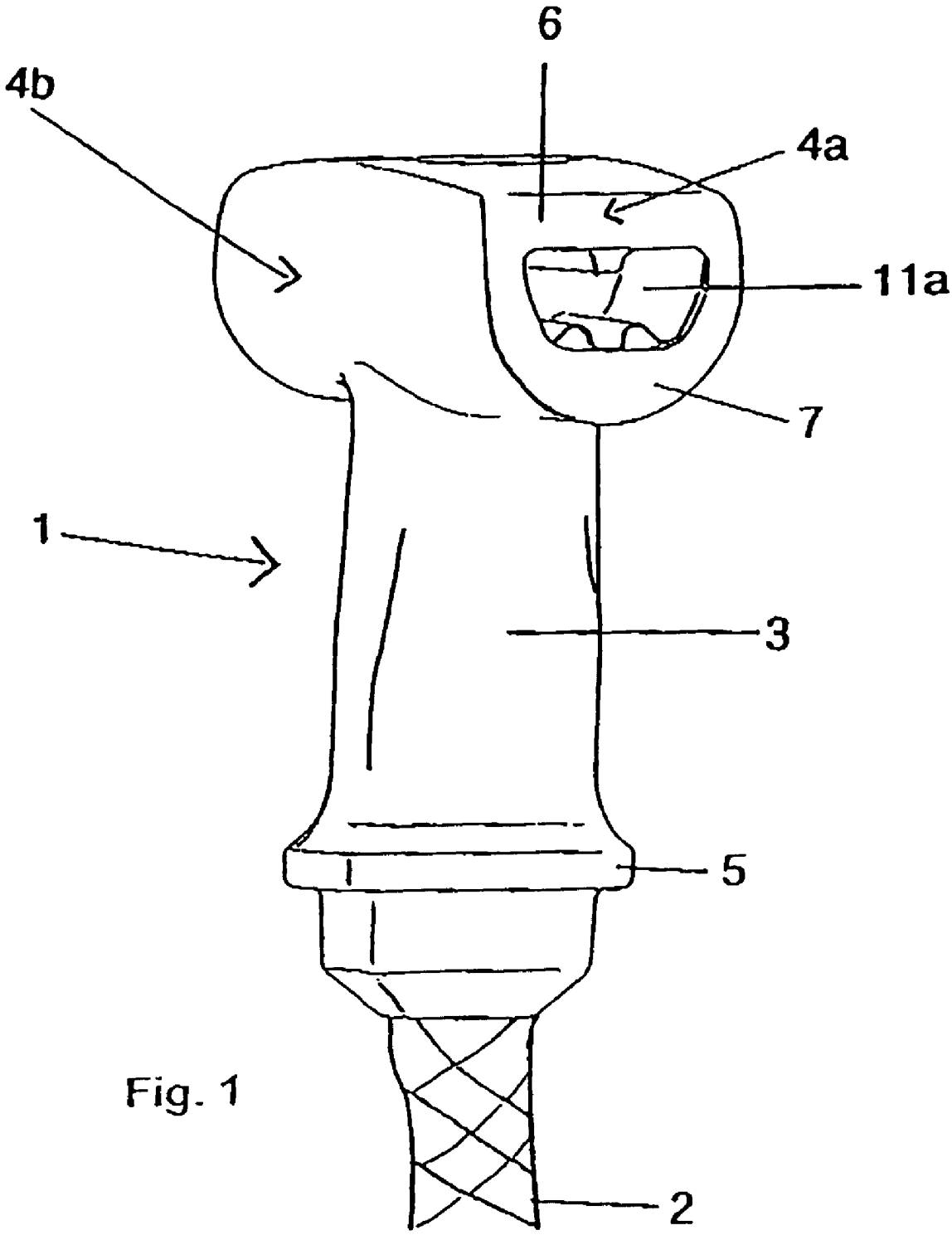
FIG. 1 shows a perspective view of the handle in accordance with the invention in one embodiment.

The handle in accordance with the invention is provided in particular as a handle for the pull-rope starter of the internal combustion engine of a hand-guided work tool such as, e.g., a motor-driven chain saw. The pull-rope starter comprises a pull rope fastened to the handle. The pull rope is wound on a reel in the state of rest. The reel is connected to the motor crankshaft via a catch mechanism. The reel can be put in rotation via the starter rope by pulling the handle. As a result thereof the catch mechanism engages and transfers the rotary motion of the reel onto the motor crankshaft. After the starter rope has been pulled off from the reel the catch mechanism disengages and the reel rolls the starter rope up by a spring mechanism for a new start attempt. The force required for pulling the handle is subjected to variations in the course of a starting process. When the piston articulated to the crankshaft via a connecting rod reaches the top dead center in the combustion chamber, that is, the compression of the fuel/air mixture is the greatest in the combustion chamber, the force to be applied for rotating the crankshaft via the handle is the greatest. These force peaks, in particular, are unpleasant for the user. The expenditure of force is subjected, in this sense, to substantially periodic variations during the course of a starting process. The damping in accordance with the invention in the handle section is capable of smoothing out in particular the force peaks occurring in the hand of the user.

Multiple start attempts, in particular, result very rapidly in the user's hand becoming tired and experiencing cramps. One reason for this is also the stiffness of the contact surface between the hand and/or the fingers in the handle. According to the invention the stiffness in the contact area between fingers and handle is reduced by the arrangement of the damping in the handle section. This makes a more pleasant starting of the drive motor possible for the user by smoothing out the force peaks.

The handle section has an elastically deformable handle wall for a particularly pleasant operation of the handle in accordance with the invention. The handle preferably comprises a smooth wall on the outside. A handle wall facing the starter rope and that is in contact with the hand of the user during starting is designed to be elastic, which directly reduces the stiffness of the contact surface. In addition, the damping as a preferably integral part of the handle can be manufactured in a cost-effective manner.

In order to prevent the handle from slipping through the hand of the user during starting, the handle section comprises a stop for the elastic handle wall. The handle wall can be deformed during starting only up to the stop over a deformation stretch. The deformation stretch via which the elastic handle wall can be deformed functions as it were as a damping stretch for smoothing out the force peaks. As long as the force to be applied is not too high the elastic handle wall is deformed to the stop, if necessary. If greater forces should occur, a further deformation of the handle beyond the stop is prevented. A slipping of the handle through the hand of the user is thus not to be feared.

The stop preferably has a profile. A corresponding profile is arranged opposite the stop profile along the deformation stretch of the deformable handle wall. The profile and the corresponding profile engage into one another via the deformation and then prevent the at least one handle section from rotating into itself. In a readily manufacturable design the profile comprises at least one groove and the corresponding profile at least one other groove. The grooves are arranged in parallel and offset relative to one another. A groove profile can be especially readily manufactured and is therefore also economical.

In an embodiment which is especially economical to manufacture because it saves material, the handle section comprises a recess arranged transversely to the starter rope. The elastic handle wall is a recessed wall facing the starter rope. The handle section can be, in particular, part of a triangular or T-shaped handle here. The stop is a stiff recessed wall facing the user in this instance. In this embodiment the stop can be designed as a one-piece molded part. It can be, e.g., a rubber tube with different wall stiffnesses. However, it is also conceivable that the tube part wall facing the user consists of a firm plastic material and that a tube part wall facing the starter rope consists of an elastic plastic. The described embodiments require little material for the manufacture on account of the recess arranged in the handle section.

It is advantageous if the stiff recessed wall and the elastic recessed wall comprise ribs that are opposite each other in the interior of the handle and that correspond with each other. The ribs function as a mutual stop and can also prevent a distortion of the handle section.

In an embodiment of the invention that can be grasped especially well and firmly by the user the handle is designed substantially in a T shape. The leg of the T comprises a fastening section and each of the two arms of the T comprises a handle section. The two T arms can be tubular with a handle wall that remains substantially uniformly thick along the circumference of the tube or that changes its thickness. The T handle can also be designed in one piece. This design requires less material in comparison to traditional T handles since the two T arms comprise recesses. In addition, the weight is advantageously reduced.

Moreover, the fastening section can comprise a recess running in the longitudinal direction through the leg of the T, which recess is widened out on the end facing the user. As a result, the T handle becomes additionally lighter on the whole and additionally more economical due to the savings of material. The fastening device is designed to be simple in that a recess that is advantageously circular in section runs through the fastening section and is widened out on the user side so that a starter rope run through the circular recess is fixed, e.g., by a knot on its end in that the knot strikes on the widened end of the recess, the enlargement.

The invention is described by way of example using the 6 figures.

Handle 1 of the invention and in accordance with FIG. 1 is fastened on one end of starter rope 2. Handle 1 and starter rope 2 are parts of a pull-rope starter of a two-cycle internal combustion engine of a motor-driven chain saw.

Handle 1 comprises fastening section and two handle sections 4*a*, 4*b*. The two handle sections 4*a*, 4*b* each comprise a recess 11*a*, 11*b*. An end of fastening section 3 on the internal combustion engine side comprises stop edge 5 for being received in a housing of a motor-driven chain saw. Each of the two handle sections 4*a*, 4*b* run vertically to the direction of tensioned starter rope 2 and are designed to be substantially tubular. The handle section comprises a stiff tube wall 6 facing the user, whose stiffness is dimensioned in such a manner that handle 1 cannot slip through the user's fingers during the starting of the internal combustion engine. Tube wall 7 facing starter rope 2 is elastic in the longitudinal direction of the tensioned starter rope. The elasticity of elastic tube wall 7 is dimensioned in such a manner that the power peaks occurring during the starting of the internal combustion engine are gently smoothed out in starter rope 2 and handle 1.

In the state of rest starter rope 2 is normally rolled up on a reel. When handle 1 is pulled, the reel is put in rotation by starter rope 2 rolling off from the reel. Claws articulated to the reel in engage by an engaging or catch mechanism in catches permanently connected to the motor crankshaft. In this manner the rotary movement of the reel can be transferred onto the crankshaft. After starter rope 2 has been pulled, the reel reels starter rope 2 back in an opposed rotary movement by a spring mechanism. During the rolling back the engaging mechanism is disengaged.

During the starting of the internal combustion engine a force is exerted on handle 1. The force deforms elastic tube wall 7 maximally up to the stop on stiff tube wall 6. A damping of the force to be applied occurs as a result of the deformation. The force to be applied during the pulling of starter rope 2 is subjected during the pulling to substantially periodic variations. The force to be applied is the greatest when the piston connected to the crankshaft via a connecting rod has reached the top dead center and the fuel/air mixture received in the combustion chamber is compressed the most. Handle 1 of the invention smoothes out the force peaks corresponding to the top dead center of the piston. The stiffness of stiff tube wall 6 facing the user is dimensioned in such a manner thereby that a slipping of handle 1 through the fingers of the user is prevented.

Figure 2:
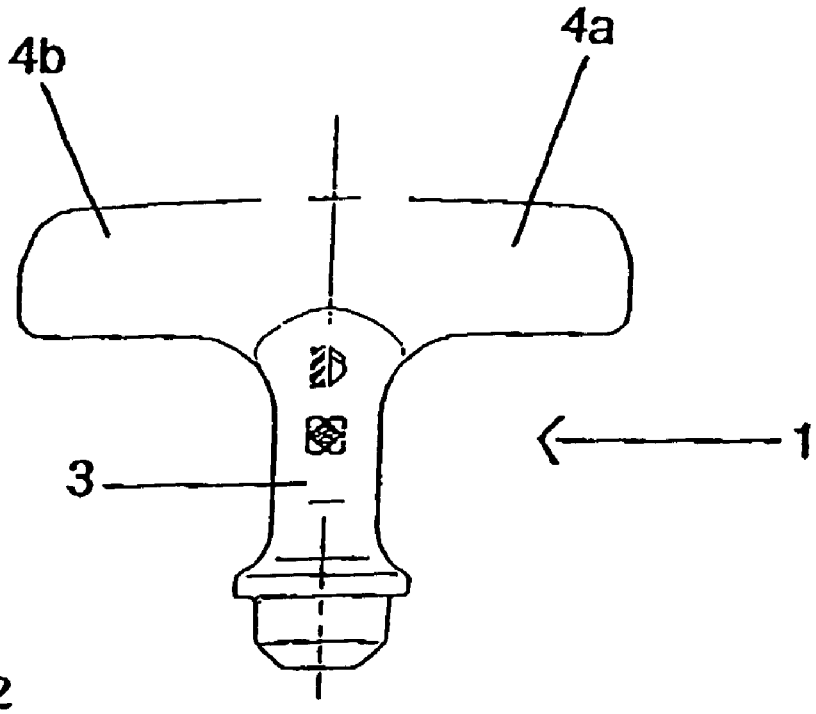
FIG. 2 shows a front view of the handle according to FIG. 1.

The front view of handle 1 of the invention displayed in FIG. 2 shows its T-shaped design. The walls of the two handle sections 4*a*, 4*b* merge smoothly into one another and together form the two T arms and the T beam of handle 1. Fastening section 3 projects centrally between the two handle sections 4*a*, 4*a* on the motor side. Handle 1 is designed to have mirror symmetry viewed from the front.

Figure 3:
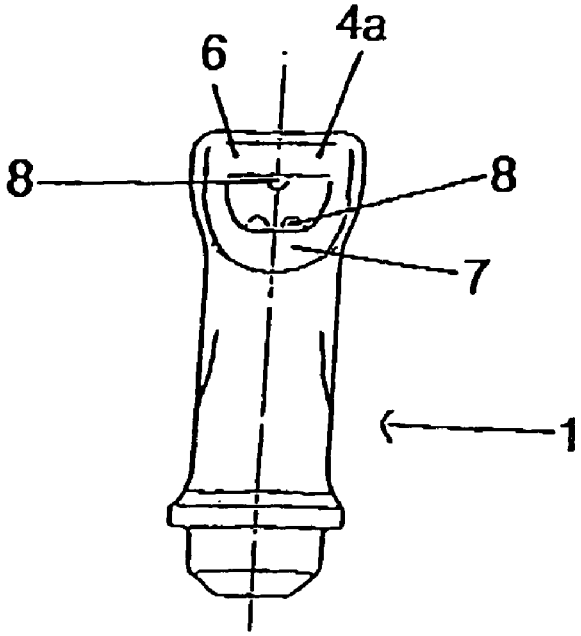
FIG. 3 shows a side view of the handle according to FIG. 1.

FIG. 3 shows handle 1 of the invention in a side view. Handle 1 is also mirror-symmetrical in the side view. Tubular handle section comprises 4*a*, 4*b* two ribs 8 on the inside on the elastic tube wall facing starter rope 2 and comprises one rib 8 on the inside on stiff tube wall 6 facing the user. The two ribs of elastic tube wall 7 are spaced parallel from one another and designed to come to a stop on rib 8 provided on the stiff tube wall.

Figure 4:
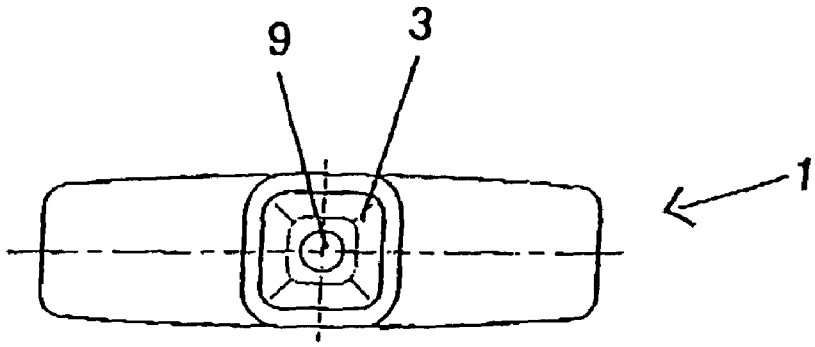
FIG. 4 shows a bottom view of the handle according to FIG. 1.

The bottom view of handle 1 shown in FIG. 4 shows fastening section 3 designed in a cross section that is substantially quadratic with rounded-off corners. The fastening section comprises a centrally arranged, circular recess 9 extending through fastening section 3 in the longitudinal direction of the T leg. Recess 9 is designed to receive an end of starter rope 2.

Figure 5:
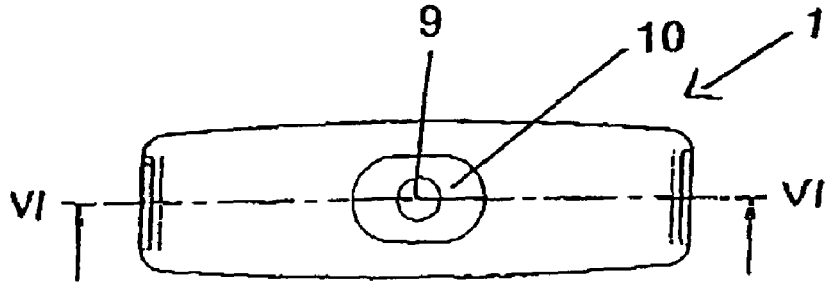
FIG. 5 shows a top view of the handle according to FIG. 1.

The top view onto handle 1 shown in FIG. 5 shows recess 9, that is circular in cross section, passes through fastening section 3 and comprises enlargement 10 on the user side. The bottom of enlargement 10 functions as a stop for the knot of the end of starter rope 2 running through recess 9.

Figure 6:
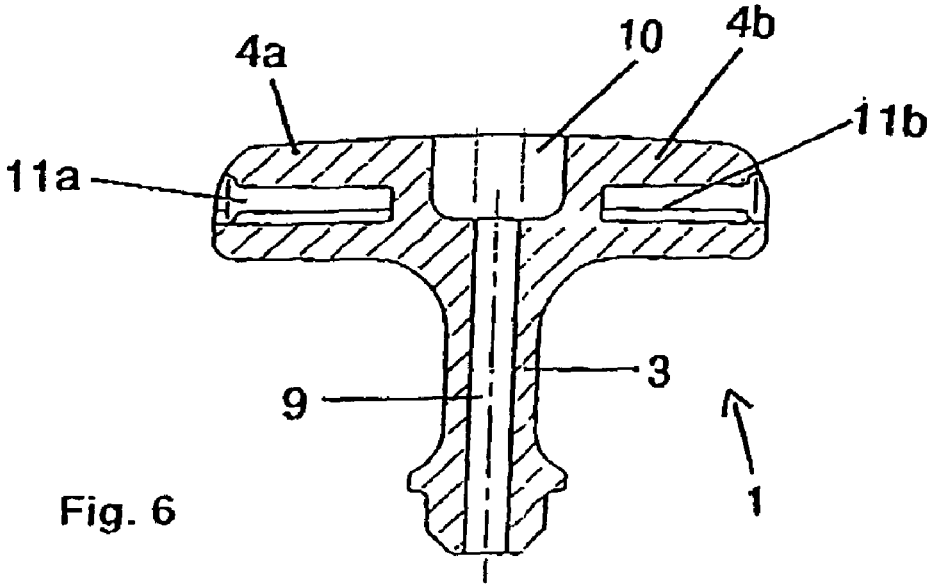
FIG. 6 shows a sectional view along line VI—VI in FIG. 5.

The sectional view shown in FIG. 6 shows circular recess 9 running through fastening section 3 and widened out on the end facing the user by enlargement 10. The two handle sections 4*a*, 4*b* each have a central recess 11*a*, 11*b* and are designed in a tubular manner. Each of central openings 11*a*, 11*b* of a handle section 4*a*, 4*b* is introduced into handle sections 4*a*, 4*b* in order to form walls of handle sections 4*a*, 4*b* that remain uniformly thick.

The invention of claimed is:

1. A handle for a pull-rope starter of a drive motor comprising at least one handle section, at least one fastening section adapted for a starter rope, and a damping adapted for smoothing out force peaks produced in the handle during the starting of the drive motor, wherein the damping is arranged in the at least one handle section, wherein the at least one handle section comprises an elastically deformable handle wall which is in contact on the outside with the hand of the user during starting, and wherein the damping comprises a stop adapted to limit a deformation stretch of the elastically deformable handle wall, and wherein the damping comprises a recess arranged transversely to a starter rope, and wherein the elastically deformable handle wall comprises a recessed wall facing the starter rope, and wherein the stop comprises a stiff recessed wall.

2. The handle according to claim 1, wherein the drive motor is a chain saw drive motor.

3. The handle according to claim 1, wherein the stop comprises a profile that cooperates with a corresponding profile located oppositely along the deformation stretch.

4. The handle according to claim 1, wherein the stop comprises at least one rib that cooperates with at least one other corresponding rib opposite the at least one rib.

5. The handle according to claim 1, wherein the stop comprises at least one rib that cooperates with at least one other corresponding rib opposite the at least one rib, and the at least one rib is arranged on the stiff recessed wall and the at least one other corresponding rib is arranged on the elastically deformable handle wall.

6. The handle according to claim 1, which is designed substantially in a T-shape having a leg section and two arm sections, where the leg section of the T comprises the fastening section and the two arm sections of the T each comprise a handle section.

* * * * *